US007954356B1

(12) United States Patent
Erbrick et al.

(10) Patent No.: US 7,954,356 B1
(45) Date of Patent: Jun. 7, 2011

(54) PEX CRIMPING TOOL

(75) Inventors: Robert M. Erbrick, Pipersville, PA (US); Joseph W. Homacki, Kintnersville, PA (US)

(73) Assignee: Electroline Corporation, Pipersville, PA (US)

( * ) Notice: Subject to any disclaimer, the term of this patent is extended or adjusted under 35 U.S.C. 154(b) by 242 days.

(21) Appl. No.: 12/363,823

(22) Filed: Feb. 2, 2009

(51) Int. Cl.
*B21D 7/06* (2006.01)

(52) U.S. Cl. ..... 72/409.12; 72/409.16; 81/367; 81/372; 81/313

(58) Field of Classification Search ..... 72/409.1, 72/409.12, 409.16; 81/367, 372, 313; 29/751
See application file for complete search history.

(56) References Cited

U.S. PATENT DOCUMENTS

| | | | | |
|---|---|---|---|---|
| 3,170,345 | A * | 2/1965 | Poingt | 72/409.12 |
| 4,144,737 | A | 3/1979 | Izraeli | |
| 4,392,263 | A | 7/1983 | Amoroso | |
| 4,463,497 | A | 8/1984 | O'Keeffe | |
| 4,611,511 | A * | 9/1986 | Mykkanen | 81/9.44 |
| 4,773,288 | A | 9/1988 | Jang et al. | |
| 4,899,445 | A | 2/1990 | Erbrick et al. | |
| 5,052,243 | A | 10/1991 | Tepic | |
| 5,138,864 | A * | 8/1992 | Tarpill | 72/409.12 |
| 5,195,353 | A | 3/1993 | Erbrick et al. | |
| 5,267,464 | A | 12/1993 | Cleland | |
| 5,307,565 | A | 5/1994 | Erbrick et al. | |
| 5,535,650 | A | 7/1996 | McNatt | |
| 5,590,470 | A | 1/1997 | Erbrick et al. | |
| 6,178,643 | B1 | 1/2001 | Erbrick et al. | |
| 6,286,358 | B1 * | 9/2001 | Beetz et al. | 72/409.12 |
| 6,550,142 | B1 | 4/2003 | Moser | |
| 6,971,179 | B2 | 12/2005 | Erbrick | |
| 7,341,285 | B2 | 3/2008 | McPherson | |
| 7,346,987 | B2 | 3/2008 | Erbrick | |
| 7,434,440 | B2 | 10/2008 | Fay | |
| 7,503,201 | B2 * | 3/2009 | Cleland et al. | 72/409.1 |
| 2007/0289353 | A1 * | 12/2007 | Fiorisi | 72/409.19 |

OTHER PUBLICATIONS

Burndy Tooling. *Type MD7 Posi-Press HyTool™*. Hand-Operated Tool pamphlet, 1 page.
ILSCO Type ND-58 Manually Operated Compression Tool, 1 page.
Jenny Tools. Electronline Corp. WD3-Compression catalog sheet, 1 page and die diagram (1 sheet).
Digital photograph of what is believed to be a Sergeant brand dual bore PEX tool from Rasta Tool Co., 1 page.
Jenny Tools website "Terminal Crimping Tools" printout (9 pages total). www.jennytools.com/store0cd0.html?pid=190802catid=19863.
Rigid Soft-Touch™ & ASTM F1807 PEX Crimp tool, Ridge Tool Co. (www.ridgid.com/tools/astmf1807-Pex-CrimpTools (1 page).

* cited by examiner

*Primary Examiner* — David B Jones
(74) *Attorney, Agent, or Firm* — Panitch Schwarze Belisario & Nadel LLP

(57) ABSTRACT

A PEX crimping tool includes four rigid links pivotally coupled together in a modified four-bar linkage arrangement. The first link has a first jaw with semicircular work face, a first handle and an elongated slot between the jaw and handle. The second link is pivotally connected with the first link at a first pivot and includes a second jaw with semicircular work face. The third link is pivotally connected with the second link at a second pivot and includes a second handle remote from the second pivot. The fourth link has a first end pivotally connected to the third link at a third pivot and includes a second end connected to the first rigid link so as to swing and move with respect to the first link about a fourth pivot movable along the elongated slot. The tools are designed to crimp ASTM F 1807 rings.

13 Claims, 8 Drawing Sheets

PEX CRIMPING TOOL

BACKGROUND OF THE INVENTION

The invention relates generally to a tool for joining tubing, and more particularly for joining tubing of "PEX" (cross linked polyethylene) material. PEX tubing (per ASTM F 876) is intended for use with hot and/or cold water in potable water and radiant heating applications (per ASTM F 877) that may be at pressures of up to 100 psi for prolonged periods of time. Joints in PEX tubing (e.g. between fittings and tubing) are commonly made by clamping. A common joint construction comprises PEX tubing on an ASTM F 1807 copper fitting held in place by an ASTM F 1807 malleable copper crimp ring. The ring is manually compressed around the tubing and the fitting with a crimp tool. While PEX tubing is relatively hard and rigid for a polymer tubing, fairly tight tolerances are required to protect the PEX tubing from damage while assuring adequate compression to secure the tubing to the fitting in a pressure sustaining, watertight manner.

Existing tools for crimping PEX copper crimp rings suffer from certain drawbacks. PEX installation often involves the formation of joints in confined spaces over the installer's head, for example, between floor joists for radiant heating systems. Most known PEX crimping tools are relatively large and heavy and require two-handed operation. They are difficult to use overhead generally and may be impossible to use in certain locations. Consequently the installer may have to locate joints at accessible but less than optimal locations and provide more joints and more tubing sections than might otherwise be necessary. Also, before crimping, the crimp rings may be easily moved out of their desired installation position while positioning the crimp tool around the ring, in which case a helper might be necessary or the tool removed to permit the ring to be repositioned. Other drawbacks will be known to users of existing PEX crimp tools.

BRIEF SUMMARY OF THE INVENTION

A PEX crimping tool according to the present invention comprises: a first rigid link including a first jaw with a first semicircular work face at one end, a first handle at an opposing end and an elongated slot located between the first jaw and the first handle; a second rigid link connected with the first rigid link so as to swing about a first pivot fixedly positioned with respect to the first and second rigid links proximate the first jaw, the second rigid link including a second jaw having a second semicircular work face facing and of an equal radius with the first semicircular work face; a third rigid link connected with the second link so as to swing about a second pivot fixedly positioned with respect to the second and third rigid links at a location on the second link spaced from the second semicircular work face and the first pivot, the third rigid link including a second handle located remote from the second pivot and adjoining the first handle; and a fourth rigid link having a first end connected to the third rigid link so as swing to about a third pivot fixedly positioned with respect to the third and fourth rigid links at a location on the third rigid link between the second fixed pivot and the second handle, the fourth rigid link further having a second end connected to the first rigid link so as to swing and move with respect to the first rigid link about a fourth pivot movable along the elongated slot.

DETAILED DESCRIPTION OF THE INVENTION

Figure 1:
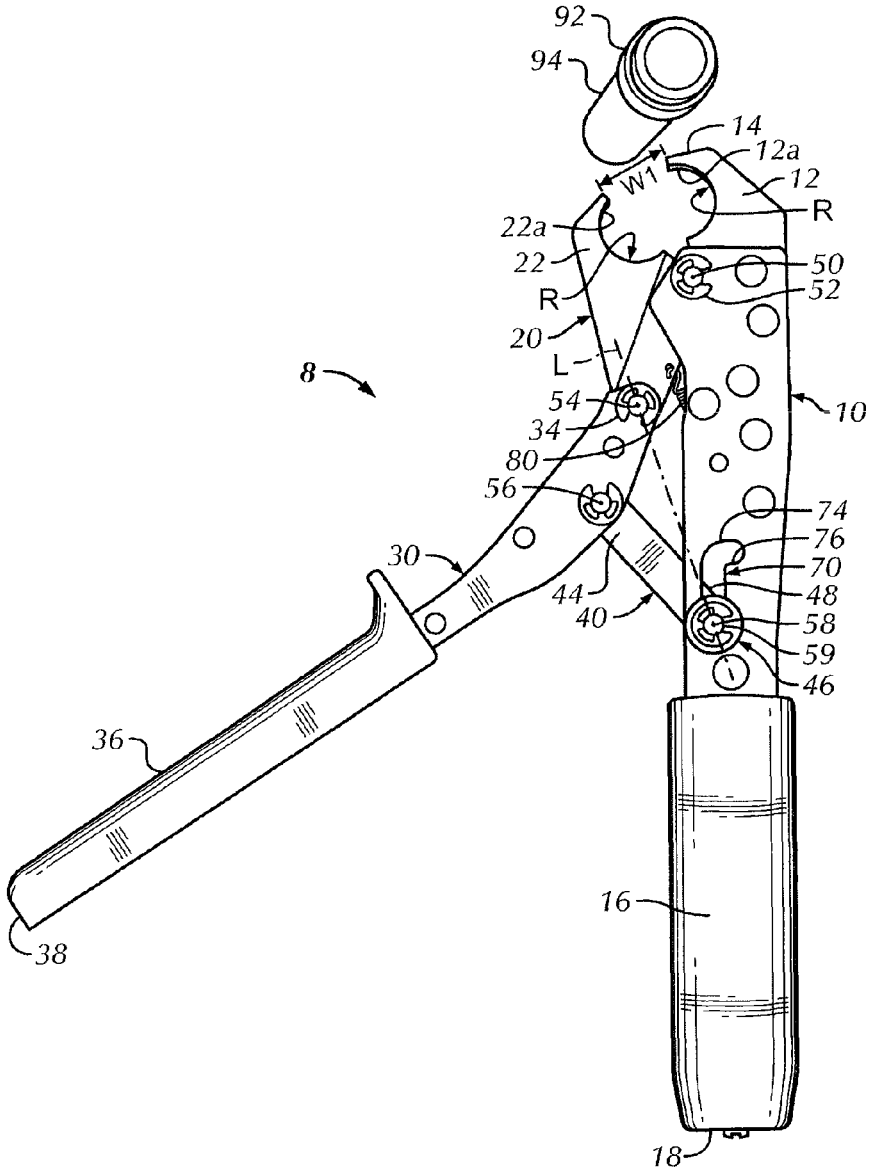
FIG. 1 shows a first embodiment PEX crimp tool according to the present invention a pair of handles separated in a first configuration with a movable link pivot located at an end of a slot proximal the handles.

Certain terminology is used in the following description for convenience only and is not limiting. The words "right," "left," "upper," and "lower" designate directions in the drawings to which reference is made. The terminology includes the words above specifically mentioned, derivatives thereof, and words of similar import.

FIGS. 1-6 depict a PEX crimping tool according to the present invention indicated generally at 8. Tool 8 comprises first, second, third and fourth rigid links 10, 20, 30 and 40, respectively, movably joined together effectively in a modified four-bar linkage arrangement.

The first rigid link 10 is generally elongated and includes a first jaw indicated generally at 12 with a first semicircular work face 12*a* of radius R at a first end 14 and a first handle 16 at an opposing second end 18. An elongated slot 70 is located between the first jaw 12 and the first handle 16.

The second rigid link 20 is connected with the first rigid link 10 so as to swing about a first pivot indicated at 50. First pivot 50 is fixedly positioned with respect to the first and second rigid links proximate the first jaw 12. The second rigid link 20 includes a second jaw 22 having a second semicircular work face 22*a* facing and of an equal radius R with the first semicircular work face 12*a*.

The third rigid link 30 is connected at a first end 34 with the second rigid link 20 so as to swing about a second pivot indicated at 54, fixedly positioned with respect to the second and third rigid links 20, 30 at a location on the second rigid link 20 spaced from the second semicircular work face 22*a* and the first pivot 50. The third rigid link 30 includes a second handle 36 located at an opposite second end 38 remote from the second pivot 54 and adjoining the first handle 16.

The fourth rigid link 40 has a first end 44 connected to the third rigid link 30 so as to swing about a third pivot indicated at 56, fixedly positioned with respect to the third and fourth rigid links 30, 40 at a location on the third link 30 between the second pivot 54 and the second handle 36. The fourth rigid link 40 further has a second end 48 connected to the first rigid link 10 so as to swing and move with respect to the first rigid link 10 about a fourth pivot indicated at 58. Both the fourth link 40 and fourth pivot 58 are movable along the elongated slot 70.

The first pivot 50 may be formed by a pin 52 passed through overlapped portions of the first and second rigid links 10, 20. Each of the second through fourth pivots 54, 56 and 58 may be similarly formed by passing a pin through the respective connected rigid links.

Each tool 8 is sized to crimp a predetermined nominal size ASTM F 1807 malleable copper crimp ring 92 on the same nominal size ASTM F 1807 fitting 96 and ASTM F 876 PEX tubing 94. The nominal sizes are ⅜", ½", ⅝", ¾", 1" and 1¼" and refer to a median diameter between the inner and outer diameters (ID and OD) of the ASTM F 876 PEX tubing. Thus a ½" tool 8 is sized to crimp a nominal ½" ring around a nominal ½" fitting and piece of nominal ½" PEX tubing within ASTM F 1807 specifications. Standards ASTM F 876, 877 and 1807 are incorporated by reference herein in their entireties.

Tool 8 is designed for one handed operation in confined spaces. Tool 8 preferably has a length of about one foot or less. According to another aspect of the invention and to assist in its usefulness, tool 8 further preferably includes a tension spring 80 connected with the second rigid link 20 between the first and second pivots 50, 54 and connected with the first rigid link 10 between the first and fourth pivots, 50, 58.

Figure 2:
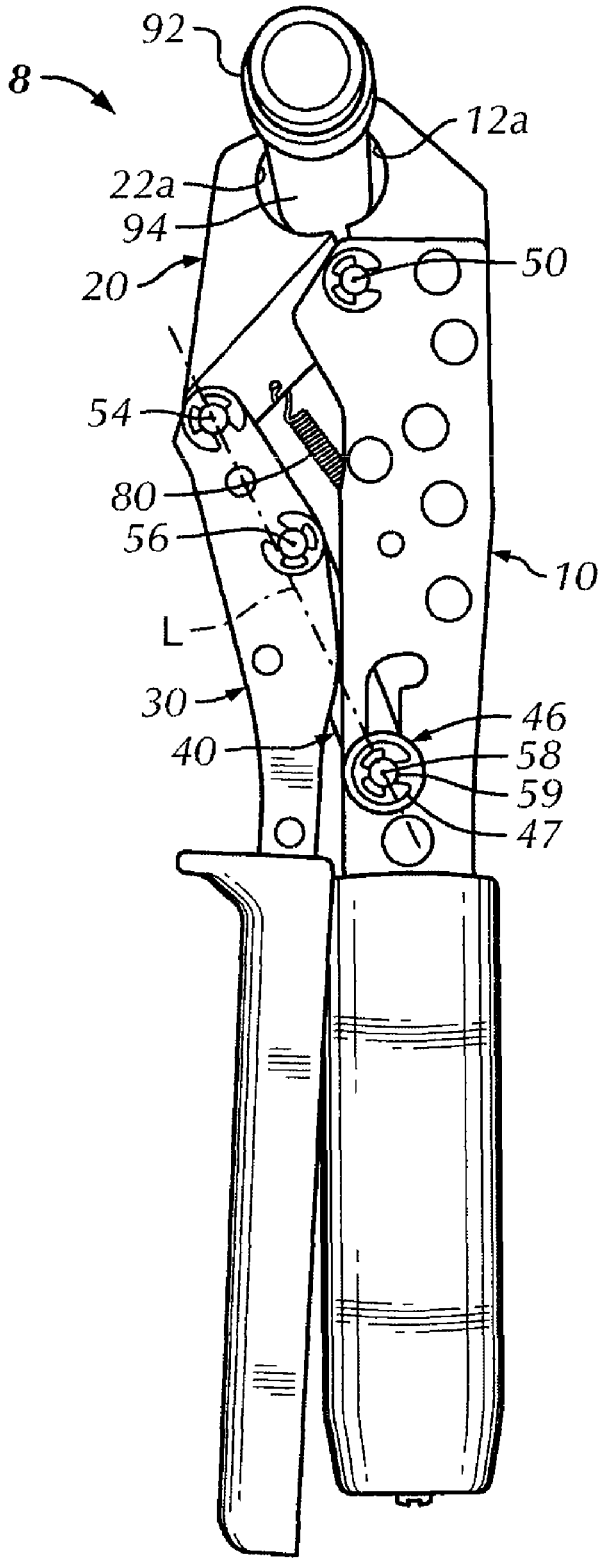
FIG. 2 shows the tool of FIG. 1 in the first configuration with the handles closed.

Referring to FIG. 1, in the open position of the handles 16, 36 in a first orientation of the tool 8 with the fourth pivot 58 located at the first end 72 of the slot 70 proximal the first handle 16, the spring 80 asserts a tension on the second link 20, biasing the second jaw 22 and second work face 22*a* away from the first jaw 12 and first work face 12*a*, and the second handle 36 away from the first handle 16. The third and fourth rigid links 30, 40 and the slot 70 are dimensioned and located such that, with the fourth pivot 58 located at the first end 72 of the elongated slot 70 proximal the first handle 16, the third pivot 56 will pass through an imaginary line ("L" in FIGS. 1 and 2) between the second and fourth pivots 50, 58 as the second handle 36 moves from open position, spread away from the first handle 16 as shown in FIG. 1, toward the first handle 16 and a closed position as shown in FIG. 2. This creates an over-center or past-center condition of the third and fourth links 30, 40 whereby, after the third pivot 56 passes through the line L toward the spring 70 and the first rigid link 10, the tension of the spring 70 now draws the third pivot 56 toward the first link 10, the first jaw 12 and work face 12*a* and second jaw 22 and work face 22*a* toward one another, and the first and second handles 16, 36 towards one another.

Figure 5:
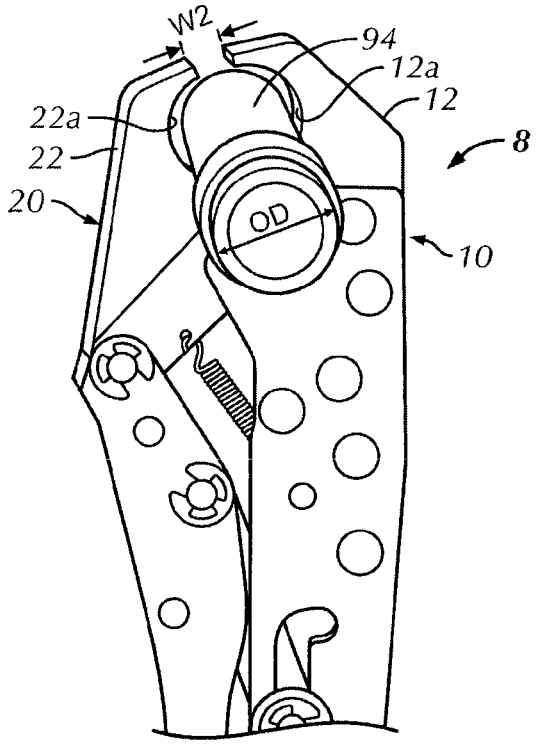
FIG. 5 is a view of the jaws of the tool in the first configuration of FIG. 2 with the handles closed in a position of self-support from a length of PEX tubing.

In the first configuration of the tool 8 with the fourth pivot 58 located at the first end 72 of the elongated slot, the extreme ends of the first and second jaws 12, 22 are biased apart as shown in FIG. 1 a distance W1 while in the over-center position in FIG. 2, they are biased together a distance W2 (see FIG. 5). Tool 8 is configured such that W1 is greater in size or magnitude than the nominal outer diameter (OD) of the PEX tubing 94 the tool 8 is designed to secure while W2 is lesser in size or magnitude than the nominal outer diameter (OD) of the PEX tubing 94 (see FIG. 5). This permits the tool 8 to be slipped with one hand over the tubing 94 simply by grasping the first handle 16 and passing the open jaws 12, 22 over the tubing 94. The tool 8 can then to be loosely closed around the tubing 94 by bringing the handles 16, 36 together as shown in FIG. 2. This can be done with one of the fingers (e.g. the pinkie) of the hand holding the first handle 16. With the handles 16, 38 together in the over-center position of the third pivot 56 in FIG. 2, the spring 70 biases the jaws 12, 22 together sufficiently strongly that the tool 8 can support itself hanging from the tubing 94 as shown in FIGS. 2 and 5.

Figure 3:
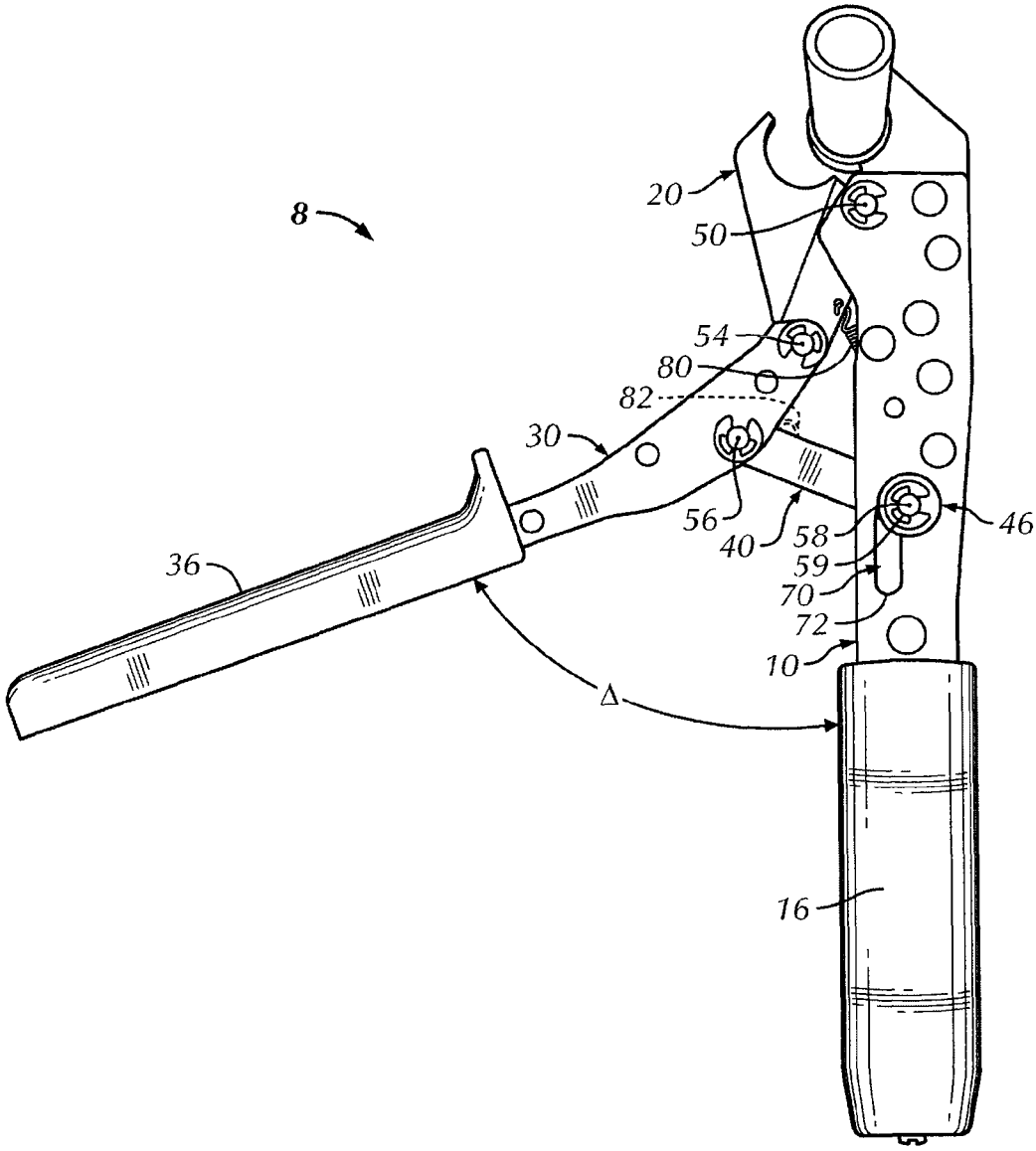
FIG. 3 shows the tool with the handles separated in a second configuration with a movable link pivot located at an opposing end of the slot distal to the handles and the handles separated for the tool jaws to be position around a crimp ring.
Figure 4:
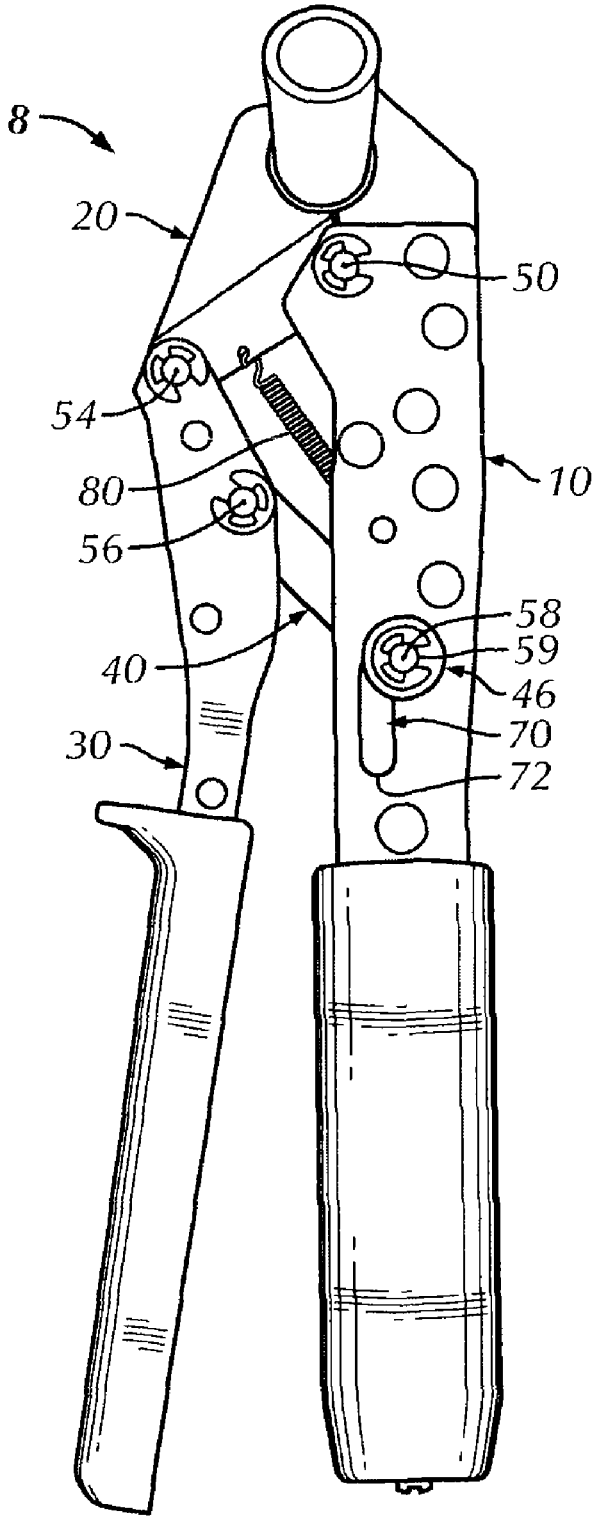
FIG. 4 shows the tool of FIG. 3 in the second orientation with the handles closed crimping a ring around a length of PEX tubing.
Figure 6:
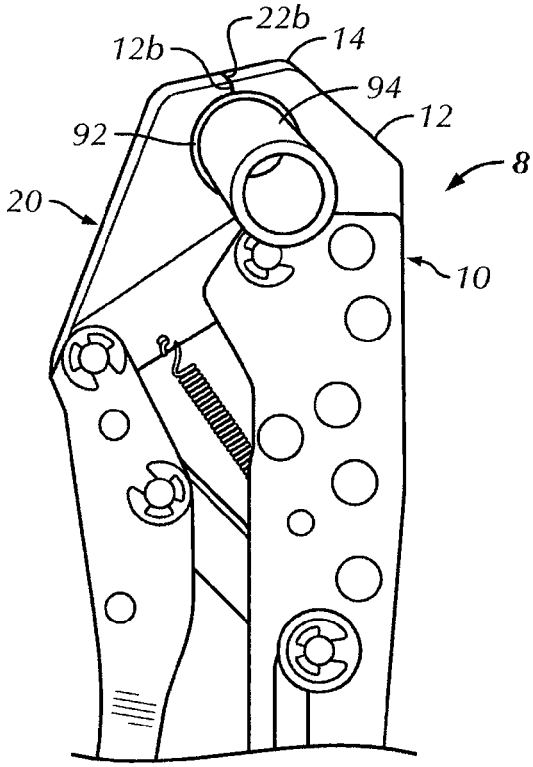
FIG. 6 is a view of the jaws of the tool in the second configuration of FIG. 4 with the handles closed encircling a crimped copper ring.

The elongated slot 70 has a stop 76 located at its second end 74 (distal to first handle 16 and proximal to first jaw 12), which stop 76 is configured to retain the fourth pivot 58 at the second end 74 of the elongated slot 70 in the second configuration of the tool 8 shown in FIGS. 3 and 4 as the first and second handles 16, 36 are brought together to crimp a ring 92. When brought together, the semicircular work faces 12*a* and 22*a* of the first and second jaws 12, 22 align and form a circle with a diameter equal to 2R and within the tolerances defined for ASTM F 1807 crimp rings. Preferably, the jaws 12 and 22 are configured so that their extreme distal tips 12*b*, 22*b* contact one another with the jaws 12, 22 closed in the second configuration of the tool 8, as shown in FIG. 6, to prevent over crimping and compression of the comparably nominally sized ASTM F 1807 crimp rings 92.

Suggestedly, the elongated slot 70 is generally hook shaped and, more preferably is essentially J shaped but it may be provided in other shapes such as U or V or still other shapes so long as the second end 48 of the fourth rigid link 40 and the fourth pivot 58 can be retained at the second end 74 of the elongated slot during a crimping action with the tool 8. Successful operation of the tool 8 requires the fourth pivot 58 to be retained at the second end 74 to permit the jaws 12, 22 to be brought fully together. That could be accomplished by the provision of a fixed pivot like pivots 50, 54, 56. Provision of the slot 70 is important in permitting the second end 48 of the fourth rigid link 40 to be moved away from the jaws 12, 22. This enables the jaws 12, 22 to be separated more widely without requiring any greater spread of the handles 16, 36, a very important consideration in using the tool 8 in restricted spaces.

The tool 8 may be fabricated in various ways but is conveniently formed by the provision of machined, single solid plate second and fourth rigid links 20, 40 and multiple, machined, solid plates layered to form the first and third rigid links 10 and 30 and provided with spaces to pivotally receive parts of the single plate, second and fourth rigid links 20, 40. The rivets shown in some of the original figures holding the layered plates together are not part of the invention.

Tool 8 further suggestedly further comprises at least one thumb tab 46 and preferably two, mirror image thumb tabs 46 at the second end 48 of the fourth rigid link 40 on opposite sides of the first rigid link 10. The thumb tab(s) 46 enable the installer or other tool user to reconfigure the tool 8 by moving the second end 48 of the fourth rigid link 40 between the first end 72 of the elongated slot 70 proximal the first handle 16 (FIGS. 1 and 2) and the opposite end 74 of the elongated slot 70 distal to the first handle 16 (FIGS. 3 and 4), using only the thumb of the hand holding the tool 8, and to disengage the fourth pivot 58 and second end 48 of the fourth link 40 from a stop 76 provided at the second end 74 of the elongate slot 70. Thumb tabs 46 on either side of the tool 8 enable the tool 8 to be used with either hand. Thumb tabs 46 may extensions of a pin 59 passed through the first and fourth rigid links 10, 40 to define the fourth pivot 58 in the elongated slot 70 or may be provided by mounting appropriate members like the small wheels 47 on the ends of such pin 59.

If desired, a stop, for example a protrusion 82 on fourth rigid link 40 (shown in phantom in FIG. 3) or something similar (but not depicted) on rigid link 30, can be provided to limit the maximum angle Δ (delta) that the handles 16, 36 can be opened in the second, crimp configuration of the tool 8 shown in FIG. 3 to limit the spread of the handles 16, 36 to thereby limit the spread of the jaws 12, 22 to the separation distance W2 shown in FIG. 5. This enables the tool 8 to be hung from the work and also be self-supporting in the second configuration before the handles 16, 36 are brought together to crimp a ring.

Figure 7:
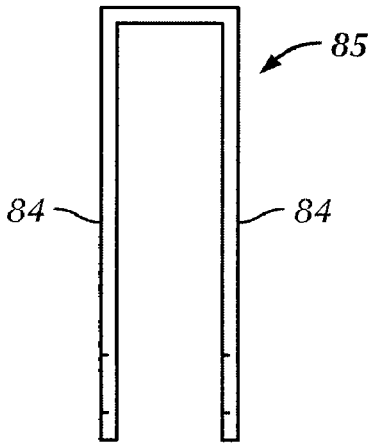
FIG. 7 depicts diagrammatically a hood defining a pair of identical guides mounted to one of the jaws to capture a ring.
Figure 8:
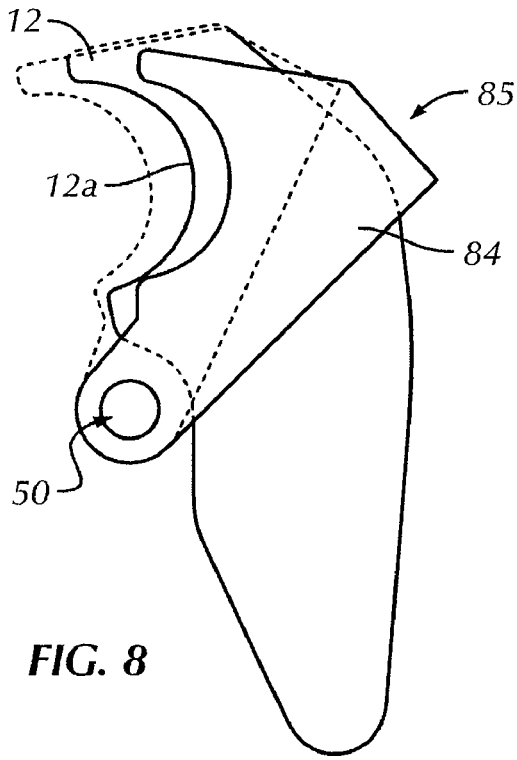
FIG. 8 is an end view of the hood of FIG. 7.

Another option would be the provision of at least one and preferably a pair of guides 84 on at least one of the jaws to keep the crimp ring located between the jaws 12, 22 before the ring is crimped. Referring to FIGS. 7 and 8, a pair of mirror image guides 84 can be provided as a one piece hood 85, mounted on the first pivot 50 to swing over the first jaw 12 toward and away from the first work face 12*a*. Each guide 84 would have a radius approximately equal to or slightly greater than R but less than the OD of an uncrimped ring. The guides 84 would be spaced apart a distance greater than the axial dimension of a ring (e.g. about 1/16 inch to either lateral sides of the work faces 12*a*, 22*a*) to capture an uncrimped ring therebetween.

The guide(s)/hood can be manually maneuvered between an advanced position (in phantom in FIG. 7) at least to and preferably beyond the proximal work face 12*a* and toward the opposing work face 12*a* and a retracted position (in solid in FIG. 7) away from both work faces and held in either position by friction. Alternatively, the guide(s) 84 and/or hood 85 can be spring loaded (spring not depicted), preferably to be lightly biased to the advanced position. A spring loaded hood 85 or guide(s) 84 can also be manually retracted and further can be made to retract automatically during a crimp action by being configured with the opposing jaw 22 to be struck by a portion of that jaw when the jaws 12, 22 are brought together in a crimp action in the second configuration of the tool.

Figure 9:
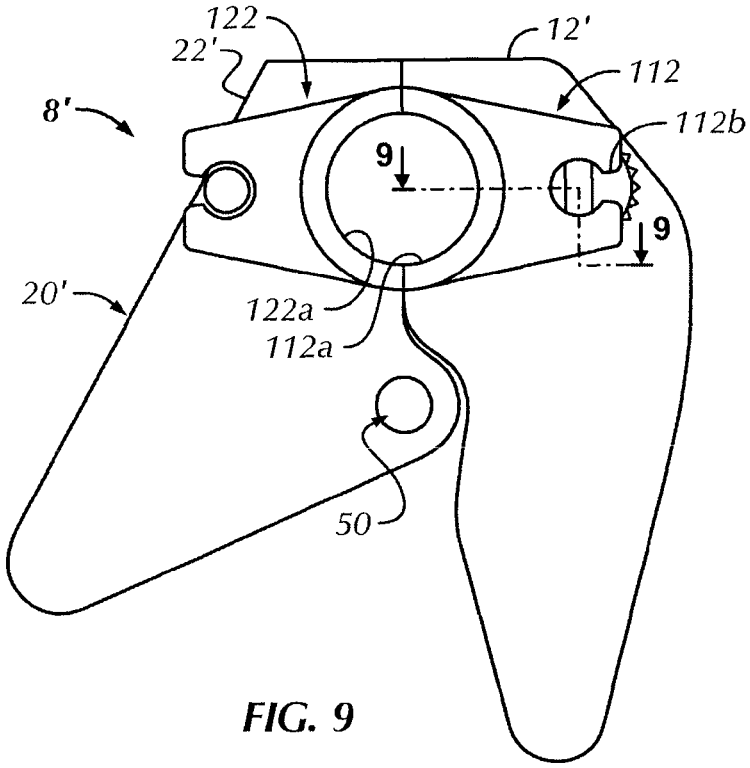
FIG. 9 depicts a pair of jaw dies, one fully mounted and the other simply located.
Figure 10:
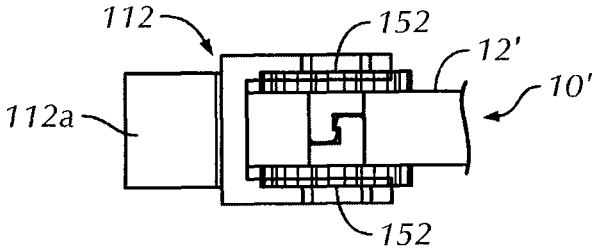
FIG. 10 is a local cross-section taken along the lines 10-10 in FIG. 9.
Figure 11:
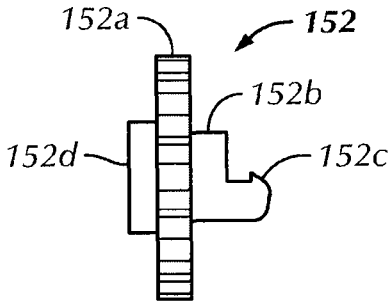
FIG. 11 is a side elevation of one of a pair of identical, self locking pin.

Another option would be the provision of two or more pairs of replaceable dies in or on the jaws, the dies having semicircular work faces of equal radii but different from the equal radii of other pairs, to make the PEX tool usable with PEX system components of more than one of the aforesaid nominal sizes. FIGS. 9-11 illustrate components of one possible modified tool 8' in which each of the semicircular work faces is formed by a separate die removably mounted on one of the first and second jaws.

A pair of dies 112 and 122 with work faces 112*a*, 122*a* are fitted over the jaws 12', 22' of first and second links 10', 20' without integral work faces. The work faces 112*a*, 122*a* are of equal radii. Each die 112, 122 is held in place by suitable means such as a bolt or other pin fastener passed through each jaw 12', 22'. Preferably, a pair of identical, interlocking molded plastic pins or "buttons" 152 can be used. One pair is shown joined in FIGS. 9-10. Referring to FIG. 11, an individual pin/button 152 is shown. The pin 152 has a knurled circular flange 152*a*, supporting a latch 152*b* on one side formed by a generally cylindrical body having a notch and cammed outer face 152*c* beyond the notch and a generally rectangular lug 152*d* on the other side. Pairs of buttons 152 are received in appropriately located bores through each of the jaws 12', 22'. The pins 152 are inserted into the bores and snapped together, the cammed faces 152*c* overriding one another. The lugs 152*d* is aligned longitudinally with the lateral openings (112*b* in FIG. 9) of the ends of the dies 112, 122 to allow the dies 112, 122 to be slipped onto the pins 152, which are then rotated 90° to their final position indicated in FIG. 9 to retain the dies 112, 122 on the jaws 12, 22. Each pair of dies sizes the tool 8' to crimp another, different predetermined ASTM F 1807 nominal size ring.

Figure 12:
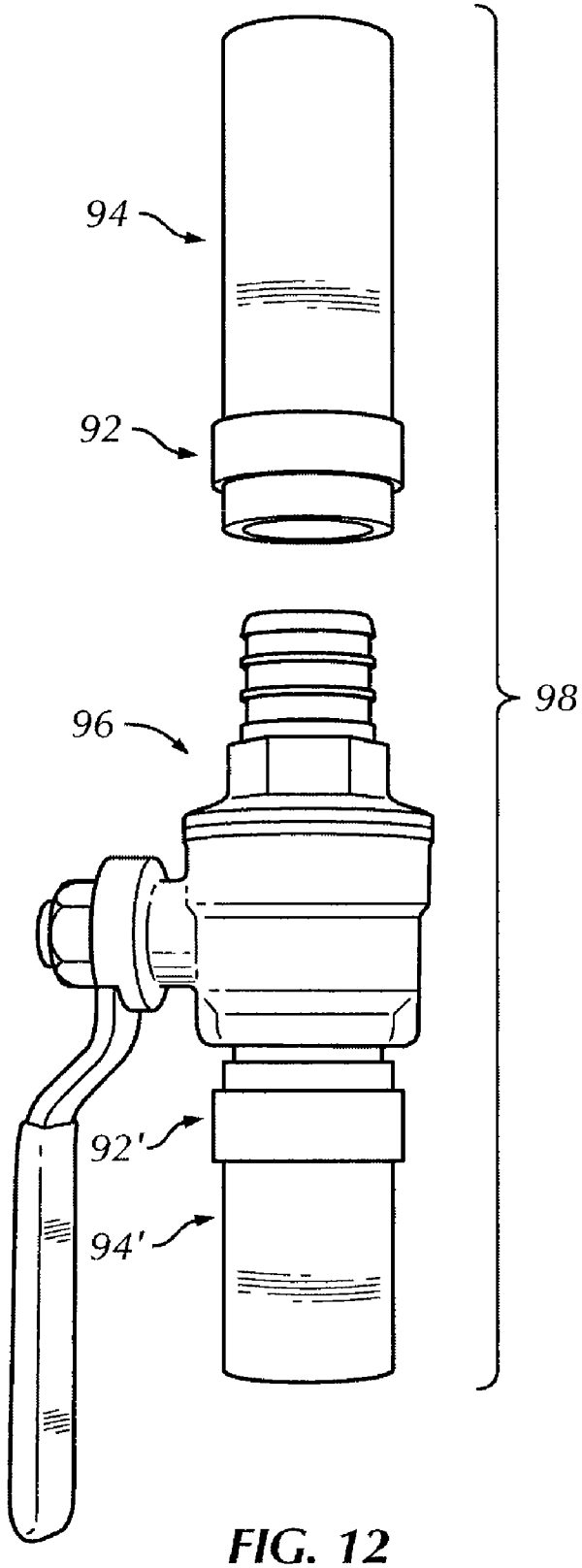
FIG. 12 depicts a typical PEX system joint formed by a length of PEX tubing mounted on a metal fitting in the form of a valve with a metal crimp ring.

FIG. 12 illustrates a conventional PEX water system joint indicated generally at 98 formed by a length of PEX tubing 94' secured to one end of a conventional, metal ASTM F 1807 fitting 96 in the form of a valve with a crimped, conventional, metal ASTM F 1807 crimp ring 92'. Another length 94 of the PEX tubing is shown ready to slide with an uncrimped ASTM F 1807 ring 92 on another spigot at the other end of the ASTM F 1807 fitting 96 to complete the joint 98 when crimped onto the spigot end of the fitting.

It will be appreciated by those skilled in the art that changes could be made to the embodiment described above without departing from the broad inventive concept thereof. It is to be understood that the invention is not limited in its application to the details of construction and to the arrangements of the components set forth in the foregoing description or illustrated in the drawings. The invention is capable of other embodiments and of being practiced and carried out in various ways. Also, it is to be understood that the phraseology and terminology employed herein are for the purpose of description and should not be regarded as limiting. It is to be understood, therefore, that this invention is not limited to the particular embodiment(s) disclosed, but it is intended to cover modifications within the spirit and scope of the present invention as defined by the appended claims.

What is claimed:

1. A PEX crimping tool comprising:

a first rigid link including a first jaw with a first semicircular work face at one end, a first handle at an opposing end and an elongated slot located and extending elongatedly in a direction between the first jaw and the first handle;

a second rigid link connected with the first rigid link so as to swing about a first pivot fixedly positioned with respect to the first and second rigid links proximate the first jaw, the second rigid link including a second jaw having a second semicircular work face facing and of an equal radius with the first semicircular work face;

a third rigid link connected with the second link so as swing about a second pivot fixedly positioned with respect to the second and third rigid links at a location on the second link spaced from the second semicircular work face and the first pivot, the third rigid link including a second handle located remote from the second pivot and adjoining the first handle; and a fourth rigid link having a first end connected to the third rigid link so as to swing about a third pivot fixedly positioned with respect to the third and fourth rigid links at a location on the third rigid link between the second fixed pivot and the second handle, the fourth rigid link further having a second end connected to the first rigid link so as to swing and move with respect to the first rigid link about a fourth pivot movable along the elongated slot, the elongated slot further extending transversely through the first link in a direction perpendicular to a plane defined by the first, second, third and fourth rigid links.

2. The PEX crimping hand tool of claim 1 further comprising a tension spring connected with the second rigid link between the first and second pivots and connected with the first rigid link between the first and fourth pivots.

3. The PEX crimping hand tool of claim 2 wherein the third and fourth rigid links and the slot are dimensioned and located such that with the fourth pivot located at a first end of the slot proximal the first handle, the third pivot will pass through a line connecting the second and fourth pivots as the second handle is moved toward the first handle.

4. The PEX crimping tool of claim 1 further comprising a thumb tab located at the second end of the fourth rigid link for user positioning of the fourth pivot along the elongated slot.

5. The PEX crimping tool of claim 1 being only about a foot or less in total length.

6. The PEX crimping tool of claim 1 wherein the elongated slot has a first end proximal the first handle and a second opposing end distal to the first handle and further comprising a stop located at the second end of the elongated slot and configured to retain the fourth pivot at the second end of the elongated slot as the first and second handles are brought together.

7. The PEX crimping tool of claim 5 wherein the elongated slot is generally hook shaped.

8. The PEX crimping tool of claim 5 wherein the elongated slot is essentially J shaped.

9. The PEX crimping tool of claim 1 further comprising at least one guide on at least one of the jaws to retain a crimp ring between the jaws.

10. The PEX crimping tool of claim 1 further comprising a pair of guides on opposite sides of at least one of the jaws to keep a crimp ring located between the jaws.

11. The PEX crimping tool of claim 10 wherein the pair of guides are mounted to swing on opposite sides of the at least one jaw.

12. The PEX crimping tool of claim 1 wherein each of the semicircular work faces is formed by a separate die removably mounted on one of the first and second jaws.

13. The PEX crimping tool of claim 1 wherein the fourth rigid link is of a fixed length.

* * * * *